US005187050A

United States Patent [19]

Yamada et al.

[11] Patent Number: 5,187,050

[45] Date of Patent: Feb. 16, 1993

[54] METHOD FOR AUTOMATIC PROCESSING OF SILVER HALIDE PHOTOGRAPHIC MATERIAL

[75] Inventors: Minoru Yamada; Takashi Toyoda; Sumito Yamada, all of Kanagawa, Japan

[73] Assignee: Fuji Photo Film Co., Ltd., Kanagawa, Japan

[21] Appl. No.: 830,527

[22] Filed: Feb. 4, 1992

Related U.S. Application Data

[63] Continuation of Ser. No. 641,613, Jan. 16, 1991, abandoned, which is a continuation of Ser. No. 328,771, Mar. 24, 1989, abandoned, which is a continuation of Ser. No. 117,606, Nov. 6, 1987, abandoned.

[30] Foreign Application Priority Data

Nov. 7, 1986 [JP] Japan ..... 61-264072

[51] Int. Cl.[5] ..... G03C 5/30

[52] U.S. Cl. ..... 430/399; 430/400; 430/419; 430/428; 430/430; 430/436; 430/438; 430/440; 430/452; 430/460; 430/466; 430/474; 430/567

[58] Field of Search ..... 430/398, 399, 400, 419, 430/428, 430, 434, 436, 438, 440, 452, 460, 466, 474, 563, 567

[56] References Cited

U.S. PATENT DOCUMENTS

| | | | |
|---|---|---|---|
| 2,772,282 | 11/1956 | Allen et al. | 430/469 |
| 2,981,623 | 4/1961 | Burgardt et al. | 430/440 |
| 3,091,537 | 5/1963 | Burness | 430/624 |
| 3,221,023 | 11/1965 | De Marle et al. | 430/474 |
| 3,288,775 | 11/1966 | Anderau et al. | 430/451 |
| 3,635,718 | 1/1972 | Froehlich et al. | 430/622 |
| 3,970,457 | 7/1976 | Parsonage | 430/398 |
| 4,297,437 | 10/1981 | Kaneko et al. | 430/376 |
| 4,407,941 | 10/1983 | Suginaka et al. | 430/440 |
| 4,414,304 | 11/1983 | Dickerson | 430/502 |
| 4,600,687 | 11/1986 | Nakamura et al. | 430/539 |
| 4,613,562 | 9/1986 | Kuse et al. | 430/399 |
| 4,741,991 | 5/1988 | Wuelfing, Jr. | 430/399 |
| 4,914,010 | 4/1990 | Momoki | 430/399 |

FOREIGN PATENT DOCUMENTS

| | | | |
|---|---|---|---|
| 1181624 | 1/1985 | Canada | 430/399 |
| 162253 | 8/1965 | Japan . | |
| 542502 | 1/1942 | United Kingdom . | |
| 943928 | 11/1963 | United Kingdom . | |
| 1093281 | 11/1967 | United Kingdom . | |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A method for processing a silver halide photographic material is described, comprising the steps of:

(a) developing a silver halide photographic material comprising a support having thereon at least one hydrophilic colloidal layer, including at least one light-sensitive emulsion layer containing tabular silver halide grains having an aspect ratio of at least about 4, the total number of hydrophilic colloidal layers having a degree of swelling of about 250% or less; and (b) after developing a predetermined amount of said silver halide photographic material, adding a single replenisher of the developer comprising a 3-pyrazolidone developing agent represented by formula (I):

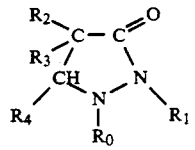

(I)

wherein $R_o$ represents a substituted or unsubstituted aryl group; and $R_1$, $R_2$, $R_3$ and $R_4$, which may be the same or different, each represents a hydrogen atom, a substituted or unsubstituted alkyl group, a substituted or unsubstituted aryl group or a substituted or unsubstituted aralkyl group, provided that when $R_o$ represents an unsubstituted phenyl group, at least one of $R_1$, $R_2$, $R_3$ and $R_4$ represents a substituted or unsubstituted alkyl group, a substituted or unsubstituted aryl group or a substituted or unsubstituted aralkyl group.

18 Claims, No Drawings

METHOD FOR AUTOMATIC PROCESSING OF SILVER HALIDE PHOTOGRAPHIC MATERIAL

This is a continuation of application Ser. No. 07/641,613 filed Jan. 16, 1991, abandoned, which is a continuation of application Ser. No. 07/328,771 filed Mar. 24, 1989, abandoned, which is a continuation of application Ser. No. 07/117,606 filed Nov. 6, 1987, abandoned.

FIELD OF THE INVENTION

This invention relates to a method for processing a silver halide photographic material, and more particularly to a convenient method for processing a silver halide photographic material by means of an automatic developing machine, which does not require complicated preparation of processing solutions.

BACKGROUND OF THE INVENTION

Silver halide photographic materials having been exposed to light are generally processed by the steps of development, fixing, and washing or stabilization. When development processing is performed using an automatic developing machine, a replenisher for a developer and a replenisher for a fixer are generally prepared by dissolving the appropriate components constituting each processing solution in water followed by mixing, and the thus-prepared replenisher is reserved in a replenisher tank and fed in a given amount to a developing tank or a fixing tank of the automatic developing machine.

The above-described automatic processing system, including automatic replenishment, is a system established through use for years. However, with the recent development of electronic equipment, the basic system in which silver halide photographic materials are wet processed has been proved to have some disadvantages.

Specifically, the components for each of the developer and fixer are dissolved in water and mixed to prepare a processing solution, and stock tanks for the thus prepared processing solutions must be provided. Further, although chemical mixers are now widely used, the disadvantage remains that the processing solutions are essentially prepared from several components and extra space is required for a chemical mixer in addition to the space for the automatic developing machine.

In order to make rapid processing possible, an emulsion-hardening reaction is generally performed during processing. However, glutaraldehyde which is usually incorporated in a developer as a hardening agent gives off an irritating smell and also is hazardous in contact with the skin. When hardening is effected by an aluminum salt which is generally used in a fixer, it is necessary to adjust the pH of the fixer to a range of from 4.2 to 4.6, at which the highest hardening reactivity can be attained, in order to suppress swelling with washing water and thereby to lessen the drying load. In this pH range, however, a part of the thiosulfate used as a main component of the fixer decomposes to generate sulfurous acid gas. Also, acetic acid, which is used as a pH buffering agent, produces a gas, thus resulting in contamination of the working environment with unpleasant smells. In some extreme cases, the produced sulfurous acid gas corrodes not only the automatic developing machine but also surrounding equipment through long-term use.

One of the causes of the above-described problems associated with automatic development lies in the hardening reaction during processing, which is usually performed by glutaraldehyde in a developer or an aluminum salt in a fixer. It has previously been known that many of the above problems can be solved by entirely omitting the glutaraldehyde hardening reaction, or by conducting the aluminum salt hardening reaction, if used, at a pH of 4.65 or higher to reduce its hardening reactivity.

In such a development processing system without a hardening step, it is essential that silver halide photographic materials should be sufficiently hardened in advance. However, if silver halide photographic materials having high sensitivity and high density, such as X-ray films for medical use, are sufficiently hardened beforehand, the required amount of silver coated must be increased, which is unfavorable from the standpoint of conservation of resources and cost.

Recently orthochromatic films used in combination with a screen containing a rare earth element have been adopted in medical X-ray photography because of improved image quality. In the orthochromatic films, the image quality can further be improved by using tabular silver halide grains so that high density may be obtained with a decreased silver coverage. Such orthochromatic films have already been marketed.

The above-described light-sensitive materials containing tabular silver halides do not undergo serious reduction in density, even when pre-hardened; that is, they exhibit sufficient photographic properties without hardening during processing, as disclosed in *Research Disclosure,* No. 22534 (Jan., 1983) and Japanese Patent Application (OPI) No. 111933/83 (the term "OPI" as used herein refers to a "published unexamined Japanese patent application").

Even if hardening during processing may be omitted by means of the above-mentioned techniques, automatic development still involves complicated preparation of processing solutions because the processing solutions consists of many components (i.e., plural parts). The complexity of the solutions has prevented simplification of processing solution preparation and size reduction of automatic developing machines.

Moreover, more rapid processing has been keenly demanded in the art. In particular, the total development time (i.e., from dry to dry) required for automatic processing of X-ray films by the use of conventional developing machines generally ranges from 90 seconds to 3 and a half minutes, and a further reduction of processing time is desired.

SUMMARY OF THE INVENTION

Accordingly, one object of this invention is to provide a method for automatically processing a silver halide photographic material, employing simplified preparation of processing solutions.

Another object of this invention is to provide a method for automatically processing a silver halide photographic material, without the necessity for a replenisher tank, to thereby reduce a floor space required for the whole automatic development system.

Further object of this invention is to provide a method for automatically processing a silver halide photographic material, which can reduce generation of offensive smells or harmful gases in the working environment and eliminate corrosion of equipment due to such gases.

Still another object of this invention is to provide a method for automatically processing a silver halide photographic material in a short processing time.

A still further object of this invention is to provide a method for automatically processing a silver halide photographic material, which eliminates the necessity of piping in an automatic developing machine, and limitations on the place for this installation.

A yet another object of this invention is to provide a method for automatically processing a silver halide photographic material, by which processing solutions can be maintained easily.

It has now been found that these and other objects of this invention can be accomplished by a method for processing a silver halide photographic material comprising the steps of:

(a) developing a silver halide photographic material comprising a support having thereon at least one hydrophilic colloidal layer, including at least one light-sensitive emulsion layer containing tabular silver halide grains having an aspect ratio of at least about 4, the total number of hydrophilic colloidal layers having a degree of swelling of about 250% or less; and (b) after developing a predetermined amount of said silver halide photographic material, adding a single replenisher of the developer comprising a 3-pyrazolidone developing agent represented by formula (I):

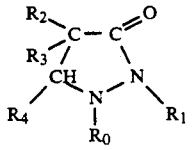

(I)

wherein $R_o$ represents a substituted or unsubstituted aryl group; and $R_1$, $R_2$, $R_3$ and $R_4$, which may be the same or different, each represents a hydrogen atom, a substituted or unsubstituted alkyl group, a substituted or unsubstituted aryl group or a substituted or unsubstituted aralkyl group, provided that when R represents an unsubstituted phenyl group, at least one of $R_1$, $R_2$, $R_3$ and $R_4$ represents a substituted or unsubstituted alkyl group, a substituted or unsubstituted aryl group or a substituted or unsubstituted aralkyl group.

DETAILED DESCRIPTION OF THE INVENTION

The present invention provides a novel processing system in which a simplified single replenisher of a developer can be used in the form of a single solution, permitting preparation of the replenisher to be incorporated into an automatic developing machine so as to be carried out easily; the space required for carrying out development processing to be reduced, and the working environment to be freed from disagreeable smells.

The compounds represented by formula (I) are disclosed in British Patents 943,928 and 1,093,281 and U.S. Pat. No. 3,221,023, but these patents neither refer to an automatic development system nor suggest the construction and effects of the present invention. The method using these compounds according to the present invention permits surprisingly simple and rapid processing techniques.

In formula (I), $R_o$ represents a substituted or unsubstituted aryl group (preferably having 10 or less carbon atoms), e.g., a phenyl group and a naphthyl group.

$R_1$, $R_2$, $R_3$, and $R_4$ each represents a hydrogen atom; a substituted or unsubstituted alkyl group (preferably having from 1 to 4 carbon atoms and particularly preferably from 2 or less carbon atoms), e.g., a methyl group, an ethyl group, a propyl group, an isopropyl group, and higher alkyl groups; a substituted or unsubstituted aryl group (preferably having 10 or less carbon atoms), e.g., a phenyl group and a naphthyl group; or a substituted or unsubstituted aralkyl group (preferably having 10 or less carbon atoms), e.g., a benzyl group.

Substituents for these groups include a hydroxyl group, an alkoxy group, a hydroxyalkyl group, an amino group, a nitro group, a sulfo group, a carboxyl group, a halogen atom, etc.

$R_1$ preferably represents a hydrogen atom, an alkyl group substituted with an amino group, or a hydroxyalkyl group. $R_4$ preferably represents a hydrogen atom.

More preferably, $R_2$ represents a hydroxyalkyl group; $R_3$ represents a hydroxyalkyl group or a substituted or unsubstituted alkyl group; and $R_o$ represents a substituted or unsubstituted aryl group.

The alkyl moieties of the above-described alkyl groups preferably have 4 or less carbon atoms.

Specific but non-limiting examples of the compounds represented by formula (I) are shown below.

1) 1-Phenyl-4,4-dihydroxymethyl-3-pyrazolidone
2) 1-p-Tolyl-4,4-dihydroxymethyl-3-pyrazolidone
3) 1-Phenyl-4-hydroxymethyl-4-methyl-3-pyrazolidone
4) 1-Phenyl-4,4-dimethyl-3-pyrazolidone
5) 1-Phenyl-2-hydroxymethyl-4,4-dimethyl-3-pyrazolidone
6) 1-Phenyl-2-morpholionomethyl-4,4-dimethyl-3-pyrazolidone
7) 1-Phenyl-2-morpholinomethyl-4-methyl-3-pyrazolidone
8) 1-Phenyl-2-hydroxymethyl-4-methyl-3-pyrazolidone
9) 1-Phenyl-5,5-dimethyl-3-pyrazolidone
10) 1-Phenyl-5-methyl-3-pyrazolidone
11) 1-p-Tolyl-4-methyl-4-hydroxymethyl-3-pyrazolidone
12) 1-p-Hydroxyphenyl-4,4-dimethyl-3-pyrazolidone
13) 1-o-Tolyl-4-methyl-4-hydroxymethyl-3-pyrazolidone
14) 1-p-Methoxyphenyl-4-methyl-4-hydroxymethyl-3-pyrazolidone
15) 1-(3,5-Dimethyl)phenyl-4-methyl-4-hydroxymethyl-3-pyrazolidone The compound of the present invention is used in an amount of generally from about 0.1 to 30 g, preferably from about 0.5 to 20 g, and more preferably from about 1 to 15 g, per liter of a developer or a replenishing solution (i.e., a replenisher).

The term "degree of swelling" as used herein means the percent of swelling obtained by comparing (a) the thickness of the hydrophilic colloidal layers measured after incubation of a photographic material at 38° C. and 50% RH for 3 days and (b) the thickness of the hydrophilic colloidal layers measured after dipping the same photographic material in distilled water at 21° C. for 3 minutes. That is, the percent of swelling is shown below.

degree of swelling (%) =

-continued $$\frac{\text{thickness of the layer after dipping} - \text{thickness of the layer after incubation}}{\text{thickness of the layer after incubation}} \times 100$$

From the standpoint of speeding up processing (e.g., reduction of drying load) and simplification of processing (e.g., omission of hardening during processing, and reduction of the number of components of processing solutions), the degree of swelling should not exceed about 250% in the present invention. Speeding up and simplification of processing can be improved with a still lower degree of swelling. On the other hand, too a small degree of swelling unfavorably decreases the rates of development, fixing, washing, etc. Accordingly, the degree of swelling preferably ranges from about 30 to 200%, and more preferably from about 50 to 150%.

It is easy for one skilled in the art to control the degree of swelling below about 250% by, for example, increasing the amount of a hardening agent added to light-sensitive materials. The conventional hardening agents which can be used include various organic compounds, such as aldehyde compounds, active halogen compounds as described in U.S. Pat. No. 3,288,775, compounds having a reactive ethylenically unsaturated group as described in U.S. Pat. No. 3,635,718, epoxy compounds as described in U.S. Pat. No. 3,091,537, halogenocarboxyaldehydes, e.g., mucochloric acid, and the like. Of these, vinylsulfone type hardening agents are preferred. In addition, high molecular hardening agents are also preferably used.

The high molecular hardening agents to be used in this invention preferably include polymers having an active vinyl group or a precursor group thereof. Particularly preferred are those polymers in which such a group is bonded to the main chain thereof via a long spacing group as described in Japanese Patent Application (OPI) No. 142524/81. The amount of these hardening agents to be added varies depending on the kinds of the hardening agent and gelatin used.

The term "aspect ratio" as used herein means the ratio of the diameter of a circle having the same area as the projected area of an individual tabular grain to the average thickness of an individual tabular grain.

The tabular grains which can be used in the present invention have an average aspect ratio of about 4 or more, and less than about 20, and more preferably at least about 5 and less than about 10. The thickness of the grains is preferably not more than about 0.3 μm, and more preferably not more than about 0.2 μm.

It is preferable that the tabular grains constitute at least about 80% by weight, and particularly at least about 90% by weight, based on the total weight of silver halide grains, in the emulsion.

By the use of the tabular grains, satisfactory photographic performance can be assured even when the simplified processing method according to the present invention is used. Further, the low degree of swelling specified above makes it possible to attain satisfactory photographic performance (e.g., sensitivity and density) even with a reduced silver coverage.

Silver halide which can be used in the silver halide emulsions may be any of silver bromide, silver iodobromide, silver iodochlorobromide, silver chlorobromide, silver chloride, and the like, with silver iodobromide containing up to about 10 mol % of silver iodide, silver bromide, and silver chlorobromide being preferred. The silver iodide may be distributed unevenly at a higher concentration in either the inside or surface of the individual grains.

During the formation of silver halide grains or subsequent physical ripening, a cadmium salt, a zinc salt, a lead salt, a thallium salt, an iridium salt or a complex salt thereof, a rhodium salt or a complex salt thereof, an iron salt or a complex salt thereof, etc. may be present in the system.

If desired, the silver halide emulsion may be subjected to chemical sensitization. Chemical sensitization can be effected by noble metal sensitization using gold compounds or compounds of other noble metals, e.g., iridium, platinum, rhodium, palladium, etc.; sulfur sensitization using sulfur-containing compounds; reduction sensitization using reducing agents, e.g., tin salts (stannic or stannous salts), polyamines, etc.; and a combination thereof.

The tabular grains can be prepared by appropriate combinations of methods known in the art. The tabular silver halide emulsions are described, e.g., in Cugnac and Chateau, *Science et Industrie Photographique* (Evolution of the Morphology of Silver Bromide Crystals During Physical Ripening), Vo. 33, No. 2, pp.121–125 (1962), Duffin, *Photographic Emulsion Chemistry*, pp. 66–72, (Focal Press 1966), A. P. H. Trivelli and W. F. Smith, *Photographic Journal*, Vol. 80, 285 (1940), etc. The tabular silver halide emulsions can be prepared easily with reference to the methods described, e.g., in Japanese Patent Application (OPI) Nos. 127921/83, 113927/83, and 113928/83.

The tabular grains can also be obtained by forming seed crystals containing at least about 40% by weight of tabular grains in an atmosphere having a relatively low pBr value, i.e., about 1.3 or less, and allowing the seed crystals to grow by simultaneously adding a silver salt solution and a halogen salt solution while keeping the pBr value at a similarly low level. During the grain growth step, addition of the silver and halogen solutions is desirably controlled so as not to form new crystal nuclei.

The size of the tabular silver halide grains can be controlled by appropriate selection of temperature, kind or amount of solvents, feed rates of the silver salt and halogen salt to be used for crystal growth, and the like.

The single layer silver spread coverage of the light-sensitive materials according to the present invention preferably ranges from about 0.5 to 5 g/m$^2$, and more preferably from about 1 to 3 g/m$^2$ In view of suitability for rapid processing, the single layer silver coverage preferably does not exceed about 5 g/m$^2$. In order to obtain constant image density and contrast, a single layer silver coverage of more than about 0.5 g/m$^2$ is preferred.

For the purpose of preventing fog during preparation, preservation or photographic processing, or stabilizing photographic performance, the photographic emulsions used in this invention can contain various compounds known as antifoggants or stabilizers, such as azoles, e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole, etc.); mercaptopyrimidines; mercaptotriazines; thioketo compounds, e.g., oxazolinethione, etc.; azaindenes, e.g., triazaindenes, tetraazaindenes (especially 4-hydroxy-substituted (1,3,3a,7)tetraazaindens, etc.), pentaazaindenes, etc.; benzenethiosulfonic acid; benzenesulfinic acid, benzenesulfonic acid amide; and the like. Examples of these compounds are described, e.g., in U.S. Pat. Nos. 3,954,474 and 3,982,947 and Japanese Patent Publication No. 28660/77. In particular, nitron or derivatives thereof described in Japanese Patent Application (OPI) Nos. 76743/85 and 7322/85; mercapto compounds described in Japanese Patent Application (OPI) No. 80839/85; heterocyclic compounds described in Japanese Patent Application (OPI) No. 64735/82; and complex salts of heterocyclic compounds and silver, e.g., silver 1-phenyl-5-mercaptotetrazole, preferably can be used.

The silver halide grains are preferably subjected to spectral sensitization with sensitizing dyes. The sensitizing dyes to be used include cyanine dyes, merocyanine dyes, complex cyanine dyes, complex merocyanine dyes, holopolar cyanine dyes, hemicyanine dyes, styryl dyes, and hemioxonol dyes, with cyanine dyes, merocyanine dyes, and complex merocyanine dyes being particularly useful. These dyes can contain any of basic heterocyclic nuclei generally employed for cyanine dyes. In particular, carbocyanine sensitizing dyes are preferred. Specific examples of these dyes are described in *Research Disclosure,* Vol. 176, RD. 17643 (Dec., 1978) and U.S. Pat. Nos. 4,425,425 and 4,425,426.

These sensitizing dyes usually are added to emulsions before coating on a support, but may be added during chemical ripening or formation of silver halide grains.

The photographic emulsions can contain a plasticizer for improving pressure characteristics, such as polymers or emulsions, e.g., alkyl acrylate latexs, and polyols, e.g., trimethylolpropane.

The photographic emulsion layers or other hydrophilic colloidal layers may further contain a wide variety of surface active agents for various purposes, such as a coating aid, as antistatic agents, for improvement of sliding properties, as emulsification and dispersion aid, for prevention of adhesion, and for improvement of photographic characteristics (e.g., development acceleration and increasing contrast or sensitivity). Specific examples of useful surface active agents include nonionic surface active agents, such as saponin (steroid type), alkylene oxide derivatives (e.g., polyethylene glycol, polyethylene glycol/polypropylene glycol condensates, polyethylene glycol alkyl ethers or alkylaryl ethers, polyethylene glycol esters, polyethylene glycol sorbitan esters, polyalkylene glycol alkylamines, polyalkylene glycol alkylamides, polyethylene oxide adducts of silicone, etc.), glycidol derivatives (e.g., alkenyl succinic polyglycerides, alkylphenyl polyglycerides, etc.), fatty acid esters of polyhydric alcohols, alkyl esters of sugars, and so on; anionic surface active agents containing an acid radical, such as carboxyl, sulfo, phospho, sulfate, phosphate and like groups, e.g., alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, and so on; amphoteric surface active agents, such as amino acids,, aminoalkylsufonic acids, aminoalkyl sulfates or phosphates, alkylbetaines, amine oxides, and so on; and cationic surface active agents, such as alkylamine salts, aliphatic or aromatic quaternary ammonium salts, heterocyclic quaternary ammonium salts, e.g., pyridinium, imidazolium, etc., and aliphatic or heterocyclic phosphonium or sulfonium salts. In particular, preferred antistatic agents are fluorine-containing compounds or polymers described in Japanese Patent Application (OPI) Nos. 249021/85 and 32462/86, nonionic surface active agents described in Japanese Patent Application (OPI) Nos. 76742/85, 80846/85, 80848/85, 80839/85, 76741/85, 208743/83, 172343/87, 173456/87, and 215272/87, and conductive polymers or latexs (nonionic, anionic, cationic or amphoteric) described in Japanese Patent Application (OPI) Nos. 204540/82 and 215272/87. Inorganic antistatic which can be used preferably include conductive tin oxide or zinc oxide or composite oxides of these metallic oxides deped with antimony, etc. Particularly preferred of these antistatic agents are fluorine-containing surface active agents.

If desired, the photographic materials according to the present invention may further contain an interlayer, a filter layer, an antihalation layer, etc.

The silver halide photographic material which can be processed by the present invention preferably has at least one silver halide emulsion layer on each side of a support, as described, e.g., in Japanese Patent Application (OPI) Nos. 127921/83, 90841/84, 111934/83 and 201235/86.

In the present invention, it is preferred that the emulsion layers and/or other hydrophilic colloidal layers contain an organic substance capable of being dissolved in the developer solution and running off during development processing. When gelatin is used as such as a substance, a gelatin that is not crosslinked by a hardening agent is preferred. Such a gelatin includes acetylated gelatin and phthalated gelatin. The molecular weight of the gelatins, is generally 50,000 or less and preferably 20,000 or less. Additional examples of effective substances capable of running off during development processing are polyacrylamides described in U.S. Pat. No. 3,271,158, and other hydrophilic polymers, e.g., polyvinyl alcohol, polyvinylpyrrolidone, etc. Sugars, e.g., dextran, sucrose, pullulan, etc., are also effective. Among these, polyacrylamide and dextran are preferred, with polyacrylamide being particularly preferred. These substances preferably have an average molecular weight of 20,000 or less, and more preferably 10,000 or less. It is preferred that these substances are lost due to run-off during processing in a ratio of from about 10 to 50%, and more preferably from about 15 to 30%, by weight based on the total coverage of organic substances other than silver halide grains.

The aforesaid organic substances capable of running off during processing may be incorporated into either an emulsion layer or a surface protective layer. When the total amount incorporated is predetermined, it is more effective to incorporate these organic substances in both an emulsion layer and a surface protective layer than in an emulsion layer alone. It is most preferred to incorporate them in a protective layer alone. In the case of light-sensitive materials composed of multiple emulsion layers, when the total amount incorporated is predetermined, it is preferred to incorporate these organic substances in higher concentrations in an emulsion layer nearer to a surface protective layer than other emulsion layers.

In addition to the above-mentioned additives, the light-sensitive materials of the present invention can contain, as a matting agent, fine particles of a homopolymer, e.g., polymethyl methacrylate, or a copolymer of methyl methacrylate and methacrylic acid as disclosed in U.S. Pat. Nos. 2,992,101, 2,701,245, 4,142,894, and 4,396,706; an organic compound, e.g., starch; and an inorganic compound, e.g., silica, titanium dioxide, strontium-barium sulfate, etc. These matting agents preferably have a particle size of from about 1.0 to 10 μm, and more preferably from about 2 to 5 μm.

The most preferred developing agents for use in black-and-white developers (or developer replenishers) which can be used in the present invention are combinations of dihydroxybenzenes and the 1-phenyl-3-pyrazolidone according to the present invention. The developers may further contain p-aminophenol type developing agents.

Specific examples of the dihydroxybenzene developing agents used in combination with the compounds of the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., with hydroquinone being particularly preferred.

Specific examples of the p-aminophenol developing agents used in combination with compounds of the present invention include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, etc. with N-methyl-p-aminophenol being preferred.

These developing agents are typically used in a total amount of from about 0.01 to 1.2 mol per liter of the developer or developer replenisher.

The developer can further contain a sulfite preservative, such as sodium sulfite, potassium sulfite, lithium sulfite, ammonium sulfite, sodium bisulfite, potassium metabisulfite, etc. Such a sulfite is preferably added in an amount of at least about 0.2 mol/l, and more preferably from about 0.4 to 2.5 mol/l.

The developer preferably has a pH of from about 9 to 13, and more preferably from about 10 to 12. Alkali agents used for pH adjustment include sodium hydroxide, potassium hydroxide, sodium carbonate, potassium carbonate, sodium tertiary phosphate, potassium tertiary phosphate, and the like. pH adjustment may also be effected by buffering agents, such as borates described in Japanese Patent Application (OPI) No. 186259/87, sucrose, acetoxime or 5-sulfosalicylic acid as described in Japanese Patent Application (OPI) No. 93433/85, phosphates, and carbonates.

The developer can furthermore contain other conventional additives, such as development inhibitors, e.g., sodium bromide, potassium bromide, and potassium iodide; organic solvents, e.g., ethylene glycol, diethylene glycol, triethylene glycol, dimethylformamide, methyl cellosolve, hexylene glycol, ethanol, and methanol; and antifoggants, such as mercapto compounds (e.g., 1-phenyl-5-mercaptotetrazole, sodium 2-mercaptobenzimidazole-5-sulfonate, etc.), indazoles (e.g., 5-nitroindazole, etc.), and benzotriazoles (e.g., 5-methylbenzotriazole, etc.). Other additives which can be incorporated into a developer, if desired, include color toners, surface active agents, defoaming agents, hard water softening agent, and amino compounds described in Japanese Patent Application (OPI) No. 106244/81.

The developer can additionally contain silver stain inhibitors, such as those described in Japanese Patent Application (OPI) No. 24347/81. Further, amino compounds, such as alkanolamines as described in Japanese Patent Application (OPI) No. 10624/81, may also be added to the developer.

In addition, other compounds described in L. F. A. Mason, *Photographic Processing Chemistry*, pp. 226–229, (Focal Press 1966), U.S. Pat. Nos. 2,193,015 and 2,592,364, and Japanese Patent Application (OPI) No. 64933/73 may also be added to the developer.

As described previously, conventional processing solutions are obtained by adding several components separated (containing several ingredients) at the period of use in order to avoid deterioration or any change of the ingredients caused by a reaction among them during the period from preparation of each component, through preparation of processing solutions, and up to use of the processing solutions. The processing solution for use is usually prepared by successively dissolving each component in previously prepared water, mixing the solution, and finally diluting to a given volume with water. Each of the components constituting a processing solution is generally a concentrate of the processing solution for use.

When light-sensitive materials are processed in an automatic developing machine, the developer concentrate is generally replenished together with water for dilution. On this occasion, it is preferred that the developer concentrate contain the smallest possible number of components (particularly preferably a single component (the term "a single component" as used herein means "a single solution" which is storage stable, containing many ingredients to be used for development)) in the present invention in view of simplicity of the machine and replenishment accuracy. If the concentrate is composed of two or more components which should be successively diluted with water as in the conventional system, extra pumps and tanks are required, and the packing material is designed as to keep each of the components apart until use, thus complicating both the replenishment operation and the automatic developing machine.

The terms "development time" and "fixing time" as hereinafter used mean the time from dipping of light-sensitive materials in a developing solution up to dipping in a fixer, and the time from dipping in a fixer up to dipping in a washing solution (or stabilizing bath), respectively. The term "washing time" as hereinafter used means the time for dipping in a washing solution. The term "drying time" as hereinafter used means the time during which the light-sensitive materials are placed in a drying zone of an automatic developing machine, wherein hot air usually of from 35° C. to 100° C., and preferably of from 40° C. to 80° C., is introduced.

The development temperature and time are preferably from about 25° to about 50° C. and from about 6 seconds to 2 minutes, more preferably from about 30° to 40° C. and from about 6 to 30 seconds, and most preferably from about 30° to 40° C. and from about 6 to 15 seconds.

A fixer (containing fixer replenisher) is an solution containing a thiosulfate, etc. and having a pH of about 3.8 or higher, preferably from about 4.2 to 5.5, and more preferably from about 4.65 to 5.5. Fixing agents to be used include sodium thiosulfate and ammonium thiosulfate and advantagenously contain a thiosulfate ion and an ammonium ion. From the standpoint of the fixing rate, ammonium thiosulfate is particularly preferred. The amount of the fixing agent to be used is subject to variation and usually ranges from about 0.1 to about 6 mol/l.

The fixer may contain, as a hardening agent, a water-soluble aluminum salt, e.g., aluminum chloride, aluminum sulfate, potassium alum, etc.

The fixer can contain tartaric acid or derivatives thereof, or citric acid or derivatives thereof either alone or in combinations thereof. These compounds are effective when added in an amount of at least about 0.005 mol/l, and particularly from about 0.01 to 0.03 mol/l. Specific examples of the tartaric or citric acid derivatives include potassium tartrate, sodium tartrate, potassium sodium tartrate, sodium citrate, potassium citrate, lithium citrate, and ammonium citrate.

If desired, the fixer can further contain a preservative (e.g., sulfites and bisulfites), a pH buffering agent (e.g., acetic acid and boric acid), a pH-adjuster (e.g., sulfuric acid), a chelating agent capable of softening hard water, or the compound described in Japanese Patent Application (OPI) No. 78551/87.

The fixing temperature and time are similar to those for development, and fixing is preferably carried out at a temperature of from about 20° to about 50° C. for a period of from about 6 seconds to 2 minutes, more preferably at a temperature of from about 30° to 40° C. for a period of from about 6 seconds to 30 seconds, and most preferably at a temperature of from about 30° to 40° C. for a period of from about 6 to 15 seconds.

A fixing tank is replenished with a concentrate of a fixer together with water for dilution as light-sensitive materials are processed by an automatic developing machine. It is desirable that the fixer concentrate used in the present invention be a single component replenisher (the term "a single component" as used herein means "a single solution" which is storage stable, containing many ingredients to be used for fixing) for the same reasons previously explained with respect to replenishment of a developer.

The pH value at which a fixer concentrate containing single-component can stably exist is about 4.5 or higher, and preferably about 4.65 or higher. If it is less than about 4.5, the thiosulfate present in the solution decomposes into a sulfide compound with the passage of time, particularly when left to stand for years before use. At a pH of about 4.5 or higher, generation of sulfur dioxide gas is suppressed, thereby keeping the working environment in good conditions. Although the upper limit of the pH range is not critical, if fixing is effected at too a high pH, the film pH remains high even after subsequent washing, causing large swelling of the film which increases the drying load. Accordingly, the upper limit of pH for fixing is generally about 7. In the case of using a fixer containing an aluminum salt for film hardening, a pH of about 5.5 is the upper limit from the standpoint of prevention of precipitation of the aluminum salt.

In the processing system according to the present invention, either one of a developer and a fixer may be a solution having a concentration suitable for running operation so that it may be supplied as it is without requiring dilution with water.

The amount of a developer or fixer concentrate supplied to a processing tank and the mixing ratio of the concentrate with diluting water depend on the composition of the concentrate. In general, the ratio of concentrate/water for dilution is from 1/0 to 1/10 preferably from 1/0 to ⅛ and particularly preferably from 1/1 to 1/5, and the amount of the developer and the fixer replenisher added preferably ranges from about 50 to 1,500 ml per $m^2$ of light-sensitive materials processed respectively.

The light-sensitive materials after development and fixing are generally subjected to washing or stabilization. The washing or stabilization can be carried out in accordance with any conventional techniques known in the art. The washing water or stabilizer used may contain various known additives. For example, use of water subjected to fungus-proofing treatment in the washing or stabilization not only makes it possible to achieve an appreciable saving of water, reducing the required amount of replenishing water to 3 l or less per $m^2$ of light-sensitive materials, but also eliminates the necessity of piping for installing an automatic developing machine and, at the same time, decreases the number of the stock tanks needed. In other words, both diluting water for preparation of a developer and a fixer and water for washing or stabilization can be fed from the same stock tank, thus reducing the size of an automatic developing machine.

More specifically, since formation of fur (i.e., undesirable slime), etc. can be prevented effectively by using fungus-proofed water in the washing water or stabilizer, the amount of replenishing water can be reduced to a range of from 0 up to about 3 l, and preferably from 0 to about 1 l, per $m^2$ of light-sensitive materials.

When the amount of replenishing water is 0 l, no replenishment is conducted, except for occasional replacement of the loss of water in a bath due to spontaneous evaporation and the like, that is, washing or stabilization is carried out substantially without replenishment.

A multi-stage countercurrent system using, for example, 2 or 3 stages, is conventionally known as a technique for decreasing the replenishing water. Application of the multi-stage countercurrent system to the present invention further increases washing efficiency because the light-sensitive material after fixing contacts water becoming cleaner as it proceeds to the next stage. According to this system, unstable thiosulfates and the like can be removed appropriately from the light-sensitive material, and subsequent discoloration of images is diminished to produce markedly improved stabilizing effects. In addition, this system permits a very great saving of washing water.

When the photographic processing according to the present invention is carried out with a small quantity of washing water, it is preferred to use a washing system provided with a sqeegee roller described in Japanese Patent Application (OPI) No. 32460/87.

A part or the whole of the overflow from a washing or stabilizing bath resulting from replenishment with fungus-proofed water may be used as a part of a processing solution having fixing capability in the step preceding the washing or stabilization step, whereby stock water can be saved and waste water reduced in quantity.

Means of fungus-proofing include ultraviolet irradiation as described in Japanese Patent Application (OPI) No. 263939/85, application of a magnetic field as described in Japanese Patent Application (OPI) No. 26394/85, purification of water by the use of an ion-exchange resin as described in Japanese Patent Application (OPI) No. 131632/86, and treatment with microbiocides as described in Japanese Patent Application (OPI) Nos. 115154/87, 153952/87, and 289532/87.

Further, germicides, fungicides, surface active agents or similar agents as described, e.g., in L. E. West, Water Quality Criteria, *Photo Sci. & Eng.*, Vol. 9, No. 6 (1965), M. W. Beach, Microbiological Growths in Motion-Picture Processing, *SMPTE Journal,* Vol. 85,(1976), R. O. Deegan, Photo Processing Wash Water Biocides, *J. Imaging Tech.,* Vol. 10, No. 6 (1984), and Japanese Patent Application (OPI) Nos. 8542/82, 58143/82, 105145/83, 132146/82, 18631/83, 97530/82, and 157244/82 can also be used alone or in combination.

In addition, the washing bath may contain, alone or, in combination, microbiocides, such as the isothiazoline compounds described in *Research Disclosure,* Vol. 205, RD 20526 (May, 1981), the isothiazoline compounds described in ibid, Vol. 228, RD 22845 (Apr., 1983), and the compound described in Japanese Patent Application (OPI) No. 289532/87.

Specific examples of fungicides are phenol, 4-chlorophenol, pentachlorophenol, cresol, o-phenylphenol, chlorophene, dichlorophene, formaldehyde, glutaraldehyde, chloroacetamide, p-hydroxybenzoic esters, 2-(4-thiazolyl)benzimidazole, benzisothiazolin-3-one, dodecylbenzyldimethylammonium chloride, N-(fluorodichloromethylthio)phthalimide, and 2,4,4'-trichloro-2'-hydroxydiphenyl ether.

The washing water may also contain the chemicals described in Hiroshi Horiguchi, *Bokin-Bobai no Kaqaku,* (Sankyo Shuppan 1982) and Nihon Bokin-Bobai Gakkai (ed.), *Bokin-Bobai Gijutsu Handbook,* (Gihodo 1986).

In view of space for equipment, water subjected to fungus-proofing treatment and preserved in a stock tank is preferably utilized both as diluting water for processing solutions, e.g., a developer and a fixer, and as washing water. It is also possible for the fungus-proofed water used as diluting water and that used for washing water (or stabilizer) to be stocked in separate tanks. Tap water also may utilized for either of diluting water and washing water.

When fungus-proofed water is separately provided for different uses, various additives can be added to the washing water (or stabilizer). For example, chelating compounds having a chelate stability constant (log K) with aluminum of about 10 or more may be added. These compounds are effective to prevent formation of a white precipitate when a fixer contains an aluminum compound as a hardening agent.

Specific examples of such chelating compounds are ethylenediaminetetraacetic acid (log K=16.1), cyclohexanediaminetetraacetic acid (log K=17.6), diaminopropanoltetraacetic acid (log K=13.8), diethylenetriaminepentaacetic acid (log K=18.4) or triethylenetetraminehexaacetic acid (log K=19.7) and sodium, potassium or ammonium salts thereof. These chelating compounds are preferably added in an amount of from about 0.01 to 10 g/l, and more preferably from about 0.1 to 5 g/l.

The washing water can further contain a silver image stabilizer, such as those described in Japanese Patent Application (OPI) Nos. 434542/83, 114035/83, and 83534/86.

The washing water can furthermore contain a wide variety of surface active agents for the purpose of preventing uneven formation of water drops. Any of cationic, anionic, nonionic, and amphoteric surface active agents may be used for this purpose. Specific examples of useful surface active agents are those described in *Kaimen Kasseizai Handbook,* Kogaku Tosho.

Also, various additives can be added to the stabilizer. Typical additives for the stabilizer include various buffers for adjustment to a pH of, e.g., about 3 to 8, such as borates, metaborates, borax, phosphates, carbonates, potassium hydroxide, sodium hydroxide, aqueous ammonia, monocarboxylic acids, dicarboxylic acids, polycarboxylic acids, and combinations thereof, and aldehydes, such as formalin. In addition, chelating agents, germicides (e.g., thiazoles, isothiazoles, halogenated phenols, sulfanilamide, benzotriazole, etc.), surface active agents, fluorescent brightening agents, hardening agents, and the like may also be used. Two or more of these compounds either for the same purpose or for different purposes may be used in combination.

It is preferred for improvement of image preservability that to adjust film pH after processing, various ammonium salts, e.g., ammonium chloride, ammonium nitrate, ammonium sulfite, ammonium thiosulfate, etc., are further contained to the stabilizer.

The above-described washing or stabilization is preferably performed at a temperature of from 0° to about 50° C. for a period of from about 6 seconds to 2 minutes, more preferably at a temperature of from about 15° to 40° C. for a period of from about 6 to 30 seconds, and most preferably at a temperature of from about 15° to 40° C. for a period of from about 6 to 15 seconds.

The thus processed photographic materials are then advantageously squeezed by means of a squeeze roller to remove excess water and then dried at a temperature of from about 40° C. to about 100° C. The drying time varies appropriately depending upon conditions and usually ranges from about 5 seconds to 1 minute, and preferably from about 5 to 30 seconds at a drying temperature of from about 40° to 80° C.

According to the method of the present invention, the lower the degree of swelling of the light-sensitive material, the shorter the drying time required. More specifically, the dry-to-dry time (i.e., the time required from the beginning development, to the end of drying) according to the present invention can be controlled generally within about 3 minutes and a half, preferably within about 100 seconds, and more preferably within about 60 seconds. In addition to the reduction in processing time, the present invention permits both simplification of preparation of processing solutions and simplification of maintenance of an automatic developing machine, due to the single component replenisher of a developer and fixer (the term "a single component" as used herein means "a single solution" which is storage stable, containing many ingredients).

The term "dry-to-dry time" as used herein means the time period between the introduction of an edge of a light-sensitive material into an inlet of an automatic developing machine and the discharge of the same edge from the machine.

The photographic materials to which the method of the present invention can be applied are not particularly restricted and include all commonly employed black-and-white light-sensitive materials. Preferred photographic materials include those used in systems in which an object, e.g., a human body, is irradiated with X-rays and the transmitted X-rays are converted to visible light rays to which the material is sensitive, such as X-ray films for direct or indirect photographing, films for CRT, and the like, e.g., X-ray photographic materials for medical or industrial use, duplicating photographic materials for X-ray, photographic materials for medical CRT images, etc.

The present invention will now be illustrated in greater detail by way of the following examples, but the present invention is not to be construed as being limited thereto. Unless otherwise indicated, all parts, percents and ratios are by weight.

EXAMPLE 1

Preparation of Peble-Like Grains (Emulsion A)

To 900 ml of water were added 20 g of gelatin, 30 g of potassium bromide, and 3.91 g of potassium iodide, and the solution was kept at 48° C. To the solution was added 35 g of a silver nitrate aqueous solution over 4 minutes while stirring. An ammoniacal silver nitrate solution containing 165 g of silver nitrate and an aqueous potassium bromide solution were simultaneously added thereto over 5 minutes by a double jet method. After completion of the addition, soluble salts were removed by sedimentation at 35° C. The solution was heated to 40° C., and 100 g of gelatin was additionally added thereto, followed by adjustment to a pH of 6.7. The resulting emulsion contained peble-like grains having an average diameter of 0.82 μm (calculated as a sphere having the same volume as the individual grain) and a silver iodide content of 2 mol %. The emulsion was chemically sensitized by a combination of gold sensitization and sulfur sensitization. The resulting emulsion was designated as Emulsion A.

Preparation of Thick Tabular Twin Grains (Emulsion B)

To 850 ml of water were added 28 g of gelatin, 30 g of potassium bromide, and 4.4 g of potassium iodide, and the solution was kept at 37° C. To the solution were added simultaneously an ammoniacal silver nitrate solution containing 45 g of silver nitrate and a aqueous potassium bromide aqueous solution over 10 minutes while stirring by a double jet method. After the addition, the solution was adjusted to a pH of 5 with acetic acid, and 105 g of silver nitrate in the form of an aqueous solution and a aqueous potassium bromide solution were further-added thereto simultaneously over 40 minutes by a double jet method. After completion of the addition, soluble salts were removed by sedimentation at 35° C. The solution was heated to 40° C., and 75 g of gelatin was further added, followed by pH adjustment to 6.4. The resulting emulsion contained thick tabular grains having an average diameter of 0.75 μm calculated from a circle having the same area as the projected area (hereinafter referred to as projected area diameter), an average thickness of 0.32 μm, and a silver iodide content of 3.0 mol %. The emulsion was subjected to chemical sensitization by a combination of gold sensitization and sulfur sensitization. The thus-prepared emulsion was designated as Emulsion B.

Preparation of Silver Iodobromide Tabular Grains (Emulsion C)

To 1 l of water were added 30 g of gelatin and 6 g of potassium bromide, and the solution was kept at 60° C. To the solution were added an aqueous solution containing 5 g of silver nitrate and an aqueous potassium bromide solution containing 0.15 g of potassium iodide over 1 minute while stirring according to a double jet method. An aqueous solution containing 145 g of silver nitrate and a aqueous potassium bromide solution containing 4.2 g of potassium iodide were further added thereto according to a double jet method. During this addition, the feed rates were elevated such that the rates at the end of addition were 5 times those at the beginning of addition. After completion of the addition, soluble salts were removed by sedimentation at 35° C., and the solution was heated to 40° C. To the solution was added 75 g of gelatin, and the pH was adjusted to 6.7. The resulting emulsion contained tabular grains having a projected area diameter of 0.98 μm, an average thickness of 0.138 μm, and a silver iodide content of 3 mol %. The emulsion was chemically sensitized by a combination of gold sensitization and sulfur sensitization. The thus prepared emulsion was designated as Emulsion C.

Preparation of Pure Silver Bromide Tabular Grains (Emulsion D)

An emulsion was prepared in the same manner as for Emulsion C, except for omitting the potassium iodide from all the halide solutions added by the double jet method. The resulting emulsion contained tabular grains having a projected area diameter of 0.89 μm and an average thickness of 0.147 μm. The emulsion was chemically sensitized by a combination of gold sensitization and sulfur sensitization. The resulting emulsion was designated as Emulsion D.

Preparation of Silver Chlorobromide Tabular Grains (Emulsion E)

Silver chlorobromide tabular grains were formed in accordance with the procedures disclosed in Example 1 of Japanese Patent Application (OPI) No. 111936/83. The total amount of silver nitrate used for the emulsion preparation was 200 g, and the amounts of other chemicals used were correspondingly adjusted based on the amounts disclosed in Example 1. The resulting tabular grains had a projected area diameter of 1.03 μm and an average thickness of 0.14 μm. After removal of soluble salts by sedimentation, the solution was heated to 40° C., and 100 g of gelatin was further added thereto, followed by pH adjustment to 6.5. The emulsion was chemically sensitized by a combination of gold sensitization and sulfur sensitization. The thus prepared emulsion was designated as Emulsion E.

Preparation of Photographic Materials (Samples 1 to 5)

An aqueous gelatin solution containing polyacrylamide having an average molecular weight of 8,000, sodium polystyrenesulfonate, polymethyl methacrylate fine particles (average particle size: 3.0 μm), polyethylene oxide, a hardening agent, etc. was used as a surface protective layer. To each of Emulsions A to E were added anhydro-5,5'-dichloro-9-ethyl-3,3'-di-(3-sulfopropyl)oxacarbocyanine hydroxide sodium salt as a sensitizing dye and potassium iodide (KI) in amounts shown in Table 1 below. To each emulsion were further added 4-hydroxy-6-methyl-1,3,3a,7-tetraazaindene, 2,6-bis(hydroxyamino)-4-diethylamino-1,3,5-triazine, and nitron as stabilizers; trimethylolpropane as a drying fog inhibitor; a coating aid; and a hardening agent. The resulting coating composition was coated on both sides of a polyethylene terephthalate support simultaneously with the above-described gelatin solution for a surface protective layer, followed by drying, to prepare Samples 1 to 5. The silver coverage on each side of each sample (i.e., in a single coated layer) is shown in Table 1.

TABLE 1

| Sample No. | Emulsion | Amount of Sensitizing Dye Added (mg/mol-Ag) | Amount of KI Added (mg/mol-Ag) | Ag Coverage Coated in Single Coated Layer (g/m$^2$) |
|---|---|---|---|---|
| 1 | A | 170 | 70 | 4.0 |

TABLE 1-continued

| Sample No. | Emulsion | Amount of Sensitizing Dye Added (mg/mol-Ag) | Amount of KI Added (mg/mol-Ag) | Ag Coverage Coated in Single Coated Layer (g/m²) |
|---|---|---|---|---|
| 2 | B | 250 | 100 | 3.0 |
| 3 | C | 500 | 200 | 2.0 |
| 4 | D | " | " | " |
| 5 | E | " | " | " |

In this example, it was necessary that the light-sensitive materials processed according to the method of the present invention should be sufficiently hardened beforehand such that the hydrophilic colloidal layers had a degree of swelling of 250% or less. The light-sensitive materials having a degree of swelling exceeding 250% would have various defects, such as drying insufficiency, serious deterioration of haze on a non-exposed area, and separation of layers during processing.

Further, according to the simplified rapid processing method of the present invention (i.e., the total time from the commencement of development up to the end of drying being within 60 seconds), it was necessary to decrease the degree of swelling to 150% or less to achieve further reduction of drying time. For this purpose, each of Samples 1 to 5 was prepared by using a varied amount of a hardening agent so as to have two different degrees of swelling indicated by a and b in Table 2. Since Emulsions A and B had a lower covering power as compared with Emulsions C to E, the silver coverages of Samples 1 and 2 were sufficiently increased to obtain gradation equal to other samples. As a result, the gelatin coverages were also increased and, therefore, attainment of equal drying properties required further reduction in the degree of swelling of these samples.

Processing I and II

Each of the samples was exposed to tungsten light through a filter absorbing light have a wavelength of 480 nm or shorter and then subjected to automatic development processing according to Processing I or II as described below.

| Step | Processing Tank Volume (l) | Processing Temperature × Time | |
|---|---|---|---|
| | | Processing I | Processing II |
| Development | 11.5 | 35° C. × 25 sec. | 35° C. × 12.5 sec. |
| Fixing | 11.5 | 35° C. × 20 sec. | 35° C. × 10 sec. |
| Washing | 11.5 | 20° C. × 15 sec. | 20° C. × 7.5 sec. |
| Drying | | 50° C. | 60° C. |

The dry-to-dry time was 96 seconds in Processing I and 48 seconds in Processing II.

The processing solutions used in Processing I and II were prepared as follows.

| Developer Formulation for 38 l: | | |
|---|---|---|
| Part A: | Potassium hydroxide | 1107 g |
| | Potassium sulfite | 1680 g |
| | Sodium hydrogencarbonate | 285 g |
| | Boric acid | 38 g |
| | Diethylene glycol | 456 g |
| | Ethylenediaminetetraacetic acid | 63.5 g |
| | 5-Methylbenzotriazole | 2.28 g |
| | Hydroquinone | 1140 g |
| | Water to make | 9.50 l |

-continued

| Developer Formulation for 38 l: | | |
|---|---|---|
| Part B: | Glacial acetic acid | 416.5 g |
| | Diethylene glycol | 644.5 g |
| | 5-Nitroindazole | 9.5 g |
| | 1-Phenyl-3-pyrazolidone | 57 g |
| Part C: | Glutaraldehyde | 187.3 g |
| | Sodium metabisulfite | 478.8 g |
| | Water to make | 950 ml |
| Starter: | Acetic acid | 270 g |
| | Potassium bromide | 300 g |
| | Water to make | 1.5 l |

In an approximately 50 l-volume stock tank for a replenisher was placed 20 l of water, and Parts A, B, and C were successively added thereto while stirring. Water was finally added to make 38 l to prepare a developer replenisher (pH=10.30).

The starter was mixed with the developer replenisher at a starter/replenisher mixing ratio of 20 ml/1 l, and the resulting developer (pH=10.15) was filled in a developing tank of an roller transfer type automatic developing machine. The developer replenisher was fed to the developing tank at a rate of 45 ml per processing of a 10×12 inch size film.

| Fixer Formulation for 38 l: | | |
|---|---|---|
| Part A: | Ammonium thiosulfate (70 w/v %) | 7.6 l |
| | Disodium ethylenediaminetetra-acetate dihydrate | 0.76 g |
| | Sodium sulfite | 570 g |
| | Boric acid | 380 g |
| | Sodium hydroxide | 254.6 g |
| | Acetic acid | 570 g |
| | Water to make | 9.5 l |
| Part B: | Aluminum sulfate | 380 g |
| | Sulfuric acid (36N) | 148.2 g |
| | Water to make | 1.9 l |

In an approximately 50 l-volume stock tank for a replenisher was placed 20 l of water, and Parts A and B were successively added thereto while stirring to dissolve, and water was finally added to obtain 38 l of a fixer replenisher.

A fixer (pH=4.25) having the same formulation as the fixer replenisher was filled in a fixing tank of the automatic developing machine. The fixer replenisher was fed to the fixing tank at a rate of 60 ml per processing of a 10×12 inch size film.

Processing III

Samples were exposed to light in the same manner as described above and then subjected to development processing according to the following procedure (Processing III):

| Step | Tank Volume | Processing Temp. | Processing Time |
|---|---|---|---|
| Development | 6.5 l | 35° C. | 25 seconds |
| Fixing | 6.5 l | 35° C. | 25 seconds |
| Washing | 6.5 l | 20° C. | 15 seconds |
| Drying | — | 50° C. | — |

The dry-to-dry time of Processing III was 100 seconds.

The processing solutions used in Processing III were prepared as follows.

| Developer Concentrate Formulation: | |
|---|---|
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone [Compound (3) of the present invention] | 5.5 g |
| 5-Methylbenzotriazole | 2 g |
| Water to make | 1 l (pH = 10.30) |
| **Fixer Concentrate Formulation:** | |
| Ammonium thiosulfate | 560 g |
| Sodium sulfite | 60 g |
| Disodium ethylenediaminetetra-acetate dihydrate | 0.10 g |
| Sodium hydroxide | 24 g |
| Water to make | 1 l |
| Acetic acid to adjust to | pH = 5.10 |

In a developing tank were placed 33 ml of the above-described developer concentrate, 667 ml of water, and 10 ml of a starter containing 2 g of potassium bromide and 1.8 g of acetic acid, and the developer was adjusted to a pH of 10.15.

In a fixing tank were placed 250 ml of the above-described fixer concentrate and 750 ml of water.

Automatic processing was continued while automatically replenishing the developing tank with 15 ml of the developer concentrate (together with 30 ml of diluting water), and the fixing tank with 10 ml of the fixer concentrate (together with 30 ml of diluting water) per processing of a 10×12 inch size film. During the automatic processing, when either of stocks of the developer, fixer, or water was emptied, the replenisher of the same formulation was added, respectively.

Processing IV

Processing IV was the same as Processing III, except that the amounts of the 4-hydroxymethyl-4-methyl-1-phenyl-3-pyrazolidone in the developer formulation was increased to 11 g, the pH of the developer formulation was changed to 10.65 by increasing the amount of the potassium hydroxide, and the processing temperature and time in each step were changed as follows.

Development: 35° C.×12.5 seconds
Fixing: 35° C.×12.5 seconds
Drying: 60° C.
Dry-to-dry Time: 50 seconds Features of each of Processing methods I to IV are summarized in Table 2.

Evaluation of Photographic Properties

Sensitivity was determined as the relative value, of the reciprocal of the exposure required for obtaining a blackening density of fog +0.5.

Fog was determined as the increase in density of white background (unexposed areas) above the base density.

Gradient was calculated as the slope of a straight line connecting the density point of fog +0.25 and the density point of fog +2.0.

The results of these measurements are shown in Table 2 below.

TABLE 2

| | Processing I | Processing II | Processing III | Processing IV |
|---|---|---|---|---|
| Preparation of Processing Solutions | Complicated because of 3-components system of developer and 2-components system of a fixer | The same as Processing I | Simple because of one-component (solution) developer and one-component (solution) fixer and automatic dilution | The same as Processing IV |
| Space | Large space needed for replenisher tanks | The same as Processing I | Small space needed for replenisher tanks | The same as Processing IV |
| Smell | Unpleasant, particularly from fixer | The same as Processing I | Substantially free from unpleasant smell | The same as Processing IV |
| Rapidness | Conventional | Rapid | Conventional | Rapid |

| Sample No. | Degree of Swelling (%) | Processing I | | | Processing II | | | Processing III | | | Processing IV | | |
|---|---|---|---|---|---|---|---|---|---|---|---|---|---|
| | | Fog | Sensitivity | Gradient | Fog | Sensitivity | Gradient | Fog | Sensitivity | Gradient | Fog | Sensitivity | Gradient |
| 1-a | 160 | 0.03 | 100* | 2.7 | 0.01 | 45 | 2.2 | 0.03 | 110 | 2.8 | 0.03 | 105 | 2.7 |
| 1-b | 60 | 0.02 | 89 | 2.55 | 0.01 | 40 | 2.0 | 0.02 | 86 | 2.5 | Insufficient desilvering by fixation | | |
| 2-a | 175 | 0.03 | 105 | 2.75 | 0.02 | 52 | 2.5 | 0.03 | 112 | 2.8 | 0.04 | 100 | 2.7 |
| 2-b | 75 | 0.025 | 95 | 2.65 | 0.02 | 45 | 2.35 | 0.03 | 105 | 2.75 | 0.04 | 100 | 2.7 |
| 3-a | 190 | 0.03 | 120 | 2.9 | 0.02 | 57 | 2.0 | 0.03 | 130 | 2.9 | 0.03 | 122 | 2.95 |
| 3-b | 100 | 0.03 | 110 | 2.85 | 0.02 | 50 | 2.8 | 0.03 | 120 | 2.9 | 0.03 | 120 | 2.9 |
| 4-a | 190 | 0.03 | 110 | 2.7 | 0.02 | 60 | 2.7 | 0.03 | 130 | 2.7 | 0.03 | 116 | 2.75 |
| 4-b | 100 | 0.03 | 105 | 2.7 | 0.02 | 57 | 2.65 | 0.03 | 115 | 2.7 | 0.03 | 115 | 2.7 |
| 5-a | 190 | 0.03 | 65 | 2.7 | 0.02 | 45 | 2.7 | 0.03 | 80 | 2.7 | 0.03 | 72 | 2.7 |
| 5-b | 100 | 0.03 | 62 | 2.7 | 0.02 | 42 | 2.7 | 0.03 | 70 | 2.7 | 0.03 | 70 | 2.7 |

Note: *The sensitivity of Sample 1-a in Processing I was taken as 100.

As is apparent from Table 2, Processing III, that is a simplified method according to the present invention, was superior to Processing I in terms of a sensitivity/fog ratio. It can also be seen that in Processing III the preparation of processing solutions was easy and that the working environment was substantially freed of unpleasant smells.

Further, Processing IV according to the present invention, that is also excellent in simplicity and rapidness, achieved rapid development combined with the benefits described above for Processing III, without reducing the sensitivity/fog ratio. When Processing III was conducted at the same rapid rate, a serious reduction in sensitivity and gradient resulted. Although Processing IV failed to fix Sample 1-b, the objects of the present invention can be accomplished when using the photographic materials according to the present invention, such as Samples 3-b to 5-b, without such a failure.

EXAMPLE 2

A developer concentrate having the same formulation as used in Processing III of Example 1, except for changing the 3-pyrazolidone compound to the compound shown in Table 3 was preserved in a full closed resin bottle at 50° C. for 2 weeks, and the percent retention (i.e., percentage of residue) of the 3-pyrazolidone compound was measured to evaluate stability in an alkaline solution. The results obtained are shown in Table 3.

TABLE 3

| 3-Pyrazolidone Compound | Retention (%) |
|---|---|
| 1-Phenyl-3-pyrazolidone for comparison | 39 |
| Compound (3) | 98 |
| Compound (4) | 100 |
| Compound (9) | 98 |
| Compound (11) | 100 |

It is apparent from Table 3 that the objects of the present invention relating to a simple and easy processing system cannot be attained unless the specific 3-pyrazolidone compounds according to the present invention are used.

As described above, the processing method of the present invention eliminates the necessity of hardening processing. The single solution (single component) developer replenisher according to the present invention makes it easier to prepare a developer and, at the same time, reduces the space for stock tanks for the processing replenisher solution, thereby reducing the space required for an automatic development system. Further, the method successfully inhibits generation of unpleasant smells in the working environment and generation of harmful gases to prevent corrosion of equipment. Furthermore, the method permits rapid processing through reduction of the degree of swelling of light-sensitive materials, enhancement of developer activity.

In addition, the easy and convenient preparation of the processing solution by means of an automatic developing machine makes it possible to install the machine without piping, lightens restrictions on installation location, and facilitates the maintenance of the machine.

While the invention has been described in-detail and with reference to specific embodiments thereof, it will be apparent to one skilled in the art that various changes and modifications can be made therein without departing from the spirit and scope thereof.

What is claimed is:

1. A method for processing a silver halide photographic material comprising the steps of:

(a) developing, in a developing solution consisting essentially of a single concentrated developer or a single concentrated developer and water comprising the components required for the development of a silver halide photographic material comprising a support having thereon at least one hydrophilic colloidal layer, including at least one light-sensitive emulsion layer containing tabular silver halide grains having an aspect ratio of at least about 4, the total number of hydrophilic colloidal layers having a degree of swelling of about 250% or less; and (b) adding to the developing solution a replenisher of the developer consisting essentially of a single concentrated developer or a single concentrated developer and water in an amount of from about 50 to 1,500 ml/m$^2$ of the photographic material processed, wherein said developing solution and replenisher thereof each contains a 3-pyrazolidone developing agent in an amount of about 0.1 to 30 g per liter selected from:

(1) 1-Phenyl-4,4-dihydroxymethyl-3-pyrazolidone,
(2) 1-p-Tolyl-4,4-dihydroxymethyl-3-pyrazolidone,
(3) 1-Phenyl-4-hydroxymethyl-4-methyl-3-pyrazolidone,
(4) 1-Phenyl-4,4-dimethyl-3-pyrazolidone,
(9) 1-Phenyl-5,5-dimethyl-3-pyrazolidone,
(10) 1-Phenyl-5-methyl-3-pyrazolidone,
(11) 1-p-Tolyl-4-methyl-5-hydroxymethyl-3-pyrazolidone,
(12) 1-p-Hydroxphenyl-4,4-dimethyl-3-pyrazolidone,
(13) 1-o-Tolyl-4-methyl-4-hydroxymethyl-3-pyrazolidone,
(14) 1-p-Methoxyphenyl-4-methyl-4-hydroxymethyl-3-pyrazolidone, and
(15) 1-(3,5-Dimethyl)phenyl-4-methyl-4-hydroxymethyl-3-pyrazolidone.

2. The method as claimed in claim 1, wherein said tabular grains have an average aspect ratio of from about 4 or more and less than about 20 and an average thickness of at most about 0.3 μm, and said silver halide comprises at least about 80 wt % of said tabular grains.

3. The method as claimed in claim 1, wherein said degree of swelling of said hydrophilic colloidal layers is from about 30 to 200%.

4. The method as claimed in claim 3, wherein said degree of swelling of said hydrophilic colloidal layers is from about 50 to 150%.

5. The method as claimed in claim 1, wherein said developer comprises from about 0.5 to 20 g of said 3-pyrazolidone developing agent per liter thereof.

6. The method as claimed in claim 1, wherein said developer comprises a combination of a dihydroxybenzene and said 3-pyrazolidone.

7. The method as claimed in claim 1, further comprising the steps of:

(c) fixing said developed silver halide photographic material from step (a);
(d) at least one of washing and stabilizing said photographic material from step (c); and
(e) drying said photographic material from step (d).

8. The method as claimed in claim 7, wherein the total processing time from the beginning of said developing step to the end of said drying step is at most about 3 minutes 30 seconds.

9. The method as claimed in claim 7, wherein the total processing time from the beginning of said development step to the end of said drying step is at most about 100 seconds.

10. The method as claimed in claim 1, wherein said silver halide photographic material is a black-and-white light-sensitive material, and said single concentrated developer further contains a dihydroxybenzene developing agent, a sulfite preservative, an antifoggant, an alkali agent and a development inhibitor.

11. The method as claimed in claim 10, wherein said sulfite preservative is at least one salt selected from the group consisting of sodium sulfite, potassium sulfite, lithium sulfite, ammonium sulfite, sodium bisulfite and potassium metabisulfite.

12. The method as claimed in claim 10, wherein said antifoggant is at least one compound selected from the group consisting of a mercapto compound, an indazole compound and a benzotriazole compound.

13. The method as claimed in claim 12, wherein the mercapto compound is selected from the group consisting of 1-phenol-5-mercaptotetrazole and sodium 2-mercaptobenzimidizole-5-sulfonate, the indazole compound is 5-nitroindazole and the benzotriazole compound is 5-methylbenzotriazole.

14. The method as claimed in claim 10, wherein said development inhibitor is at least one salt selected from the group consisting of sodium bromide, potassium bromide and potassium iodide.

15. The method as claimed in claim 10, wherein said black-and-white light-sensitive material is an X-ray film for direct or indirect photographing, an X-ray photographic material for medical or industrial use, a duplicating photographic material for X-ray, or a photographic material for CRT image.

16. The method as claimed in claim 1, wherein the developer and replenisher thereof contain no glutaraldehyde type hardener.

17. The method as claimed in claim 1, wherein the developing solution and replenisher thereof are obtained by diluting the single concentrated developer with water in a ratio of developer concentrate/water of from 1/0 to 1/10.

18. The method as claimed in claim 1, wherein the developing solution consists of a single concentrated developer or diluted solution thereof and the replenisher of the developer consists of a single concentrated developer of diluted solution thereof.

* * * * *